US010690075B2

(12) United States Patent
Segtrop et al.

(10) Patent No.: US 10,690,075 B2
(45) Date of Patent: Jun. 23, 2020

(54) CONTROL UNIT FOR A COMBUSTION ENGINE

(71) Applicant: Volkswagen Aktiengesellschaft, Wolfsburg (DE)

(72) Inventors: Benjamin Segtrop, Braunschweig (DE); Michael Mazur, Hannover (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 6 days.

(21) Appl. No.: 15/596,013

(22) Filed: May 16, 2017

(65) Prior Publication Data

US 2017/0248091 A1 Aug. 31, 2017

Related U.S. Application Data

(63) Continuation of application No. PCT/EP2015/076845, filed on Nov. 17, 2015.

(30) Foreign Application Priority Data

Nov. 17, 2014 (DE) ..... 10 2014 116 748

(51) Int. Cl.
*G06G 7/70* (2006.01)
*F02D 41/14* (2006.01)

(52) U.S. Cl.
CPC ..... *F02D 41/1406* (2013.01); *F02D 2250/36* (2013.01); *F02D 2250/38* (2013.01)

(58) Field of Classification Search
CPC ..... F02D 41/1406; F02D 2250/36; F02D 2250/38

(Continued)

(56) References Cited

U.S. PATENT DOCUMENTS 6,417,852 B2 * 7/2002 Sevastyanov ..... G06T 11/206 345/440
7,921,371 B1 * 4/2011 Roubtsov ..... G06F 17/5095 715/215

(Continued)

FOREIGN PATENT DOCUMENTS

AT 510328 A2 3/2012
CN 1637751 A 7/2005

(Continued)

OTHER PUBLICATIONS

Arturo de Risi, Optimization of the Combustion Chamber of Direct Injection Diesel Engines, Jan. 2003, Society of Automotive Engineers, Inc. [see attached PDF].*

(Continued)

*Primary Examiner* — Hung Q Nguyen
*Assistant Examiner* — Anthony Donald Taylor, Jr.
(74) *Attorney, Agent, or Firm* — Manfred Beck, P.A.

(57) ABSTRACT

A control configuration for a combustion engine includes a control unit which has a function that determines a reference variable by taking into account an operating state information, an upper limit and a cumulative actual variable. The reference variable influences an operating state of the combustion engine such that a plurality of actual variables are adjusted so that, in an operating time period with a combination of arbitrary different operating states of the combustion engine that are set in a random order, cumulative actual variables do not exceed upper limits in this operating time period, wherein a target function is minimized by selecting the reference variable from Pareto-optimal alternatives through use of an indifference curve. A combustion engine and a vehicle are also provided.

9 Claims, 4 Drawing Sheets

(58) Field of Classification Search
USPC ..... 701/102, 103
See application file for complete search history.

(56) References Cited

U.S. PATENT DOCUMENTS

| | | | | |
|---|---|---|---|---|
| 9,760,532 | B2 * | 9/2017 | Wallner | G06F 17/11 |
| 2005/0032013 | A1 * | 2/2005 | Bueche | F02C 7/222 431/217 |
| 2005/0084811 | A1 * | 4/2005 | Bueche | F23D 14/02 431/1 |
| 2005/0143845 | A1 * | 6/2005 | Kaji | G05B 13/0265 700/28 |
| 2009/0222245 | A1 * | 9/2009 | Hashimoto | F02D 41/2432 703/2 |
| 2011/0264353 | A1 * | 10/2011 | Atkinson | F02D 41/1402 701/102 |
| 2014/0344320 | A1 | 11/2014 | Wallner et al. | |
| 2015/0370228 | A1 * | 12/2015 | Kohn | G06Q 50/06 700/31 |
| 2015/0370232 | A1 * | 12/2015 | Kohn | G06Q 50/06 700/29 |
| 2016/0004228 | A1 * | 1/2016 | Kohn | G06Q 50/06 700/29 |
| 2016/0018806 | A1 * | 1/2016 | Kohn | G06Q 50/06 700/295 |

FOREIGN PATENT DOCUMENTS

| | | | |
|---|---|---|---|
| DE | 102006007122 | A1 | 8/2007 |
| EP | 2096565 | A1 | 9/2009 |
| JP | 2008234439 | A | 10/2008 |
| WO | 2013087307 | A2 | 6/2013 |

OTHER PUBLICATIONS

Heiko Sequenz: "Emission Modelling and Model-Based Optimisation of the Engine Control," D17 Darmstadt Dissertations 2012, retrieved from http://tuprints.ulb.tu-darmstadt.de/3948/, pp. 1-3, 74-87.

Kristian Jankov: "Beitrag zur automatisierten Steuerkennfeld-Applikation bei Fahrzeug-Dieselmotoren," Aug. 28, 2008, XP055036695, retrieved from http://opus.kobv.de/tuberlin/volltexte/2008/1972/pdf/jankov kristian.pdf, chapter 2.5.3.

Hoel Langouet et al: "Engine calibration: multi-objective constrained optimization of engine maps," Optimization and Engineering; International Multidisciplinary Journal to Promote Dptimizational Theory & Applications in Engin, Kluwer Academic Publishers, BO, vol. 12, No. 3, Apr. 5, 2011, pp. 407-424, XP019926451, ISSN: 1573-2924, DOI: 10.1007/S11081-011-9140-8, chapter 2.2.

Alberer D et al: "A virtual references design approach for diesel engine control optimization," Control Engineering Practice, Pergamon Press, Oxford, GB, vol. 18, No. 11, Nov. 1, 2010, pp. 1263-1271, XP027472048, ISSN: 0967-0661, DOI: 10.1016/J.CONENGPRAC.2010.09.003, the whole document.

Search Report including Provisional Assessment of Patentability issued by the German Patent and Trademark Office for German Patent Application No. DE 10 2014 116 748.1, dated Nov. 5, 2015.

International Search Report for International Application No. PCT/EP2015/076845 and translation thereof, dated Feb. 4, 2016.

International Preliminary Report on Patentability for International Application No. PCT/EP2015/076845 and translation thereof, dated Mar. 2, 2017.

R. Timothy Marler et al., "The weighted sum method for multi-objective optimization: new insights," Structural and Multidisciplinary Optimization, vol. 41, No. 6, Dec. 12, 2009, pp. 853-862.

Office Action, dated Jan. 2, 2019, issued by the European Patent Office for Application No. EP 15 795 168.2, which is related to U.S. Appl. No. 15/596,013.

Search Report dated Jul. 9, 2019, issued by the State Intellectual Property Office of People's Republic of China for Chinese Patent Application No. CN 201580061916.0 which is related to U.S. Appl. No. 15/596,013.

Office Action dated Jul. 18, 2019 and translation thereof, issued by the State Intellectual Property Office of People's Republic of China for Chinese Patent Application No. CN 201580061916.0 which is related to U.S. Appl. No. 15/596,013.

* cited by examiner

CONTROL UNIT FOR A COMBUSTION ENGINE

CROSS-REFERENCE TO RELATED APPLICATIONS

This application is a continuation, under 35 U.S.C. § 120, of copending International Application No. PCT/EP2015/076845, filed Nov. 17, 2015, which designated the United States; this application also claims the priority, under 35 U.S.C. § 119, of German Patent Application No. DE 10 2014 116 748.1, filed Nov. 17, 2014; the prior applications are herewith incorporated by reference in their entirety.

BACKGROUND OF THE INVENTION

Field of the Invention

The invention relates to a control unit for a combustion engine for determining at least one reference variable for a combustion engine.

Control units are used to control important engine functions in the vehicle field. In particular, they are used, in addition to design-engineering measures such as combustion chamber design and the influence on mixture formation by injection systems and injection methods, to reduce fuel consumption and the related $CO_2$ emissions and significant exhaust gas components such as carbon monoxide (CO), hydrocarbons (HC), oxides of nitrogen (NOx) as well as carbon black and particles during engine operation.

Known functions of a control unit receive information about an operating state of the engine (for example revolution rate, torque, desired torque, temperature, DPF (Diesel Particle Filter) loading) and determine reference variables that influence consumption and emissions during operation.

For determining these reference variables, engine characteristic fields that are also stored in the control unit are often used, in which for example a setpoint exhaust recirculation rate or a setpoint charging pressure are stored depending on the aforementioned operating state.

Suitable reference variables are for example exhaust recirculation rate, exhaust recirculation distribution, filling, injection point in time and ignition point in time. Control variables (for example choke flap position, position of a VTG (Variable Turbine Geometry)) are then derived from the reference variables.

The term "combustion engine" includes in this context the entire combustion engine system with all the units, auxiliary units and control elements thereof.

With this strategy, it can be ensured that the upper emission limits are not exceeded in specified speed profiles by an optimized assignment of certain reference variables. Standard driving cycles are an example of such speed profiles, for example the NEDC (New European Driving Cycle), which are driven to determine the exhaust and/or consumption values. For such cycles, for example global optimization approaches are known, as specified in Heiko Sequenz: Emission Modelling and Model-Based Optimisation of the Engine Control, D17 Darmstadt Dissertations 2012.

During real driving operations (and possibly during the so-called Real Driving Emissions Test Method) different arbitrary speed profiles and operating states occur, which are unknown before and during the trip.

As the individual operating states already include different emission values independently of the engine control, the consumption and emission values (l/100 km or mg/km) can sometimes deviate significantly downwards or upwards in these different arbitrary driving profiles. The global optimization of for example fuel consumption or $CO_2$ emissions while not exceeding emission limits is thus no longer provided by the known control strategies.

In particular, with competing emission variables, such as occur for example in a diesel engine during carbon black (particle) emissions and oxides of nitrogen emissions, situations can occur in which for example the permissible oxides of nitrogen emissions are exceeded and the carbon black emissions fall significantly below permissible carbon black emissions in a speed profile.

SUMMARY OF THE INVENTION

It is accordingly an object of the invention to provide a control configuration for a combustion engine which at least partly overcomes the above-mentioned disadvantages of the heretofore-known configurations of this general type and which is suitable, in case of real driving emission test methods, to optimize the reference variables, such as for example exhaust gas recirculation rate (EGR Rate), EGR distribution (high pressure/low pressure), filling and rail pressure, but also the use of exhaust aftertreatment systems such as for example diesel particle filters and SCR (Selective Catalytic Reduction), in relation to the fuel and AdBlue® consumption as well as the emission variables.

With the foregoing and other objects in view there is provided, in accordance with the invention, a control configuration for a combustion engine, including:

a control unit having a function that determines a reference variable by taking into account an operating state information, an upper limit and a cumulative actual variable; and the reference variable influencing an operating state of the combustion engine such that a plurality of actual variables are adjusted so that, in an operating time period with a combination of arbitrary different operating states of the combustion engine that are set in a random order, cumulative actual variables do not exceed upper limits in the operating time period, wherein a target function is minimized by selecting the reference variable from Pareto-optimal alternatives through use of an indifference curve.

In other words, according to the invention there is provided a control unit (1) for a combustion engine (2), with a function that, while taking into account operating state information (FW, SB), an upper limit and a cumulative actual variable, determines a reference variable (x(t)) that influences an operating state of the combustion engine (2) so that a plurality of actual variables are adjusted such that cumulative actual variables do not exceed upper limits in an operating time period with a combination of arbitrary different operating states of the combustion engine (2) that are set up in random order in the operating time period, wherein a target function is minimized by selecting the reference variable (x(t)) from Pareto-optimal alternatives through the use of an indifference curve (I).

According to another feature of the invention, the target function includes at least one variable selected from the group including an actual emission variable, a fuel consumption and a $CO_2$ emission.

According to yet another feature of the invention, the operating state information includes a revolution rate and a setpoint torque.

According to a further feature of the invention, the operating time period and the different operating states of a trip are known.

According to another feature of the invention, actual emission variables include at least two variables selected from the group including an NOx emission, an HC emission, a CO emission, the $CO_2$ emission, a combined HC and NOx emission, a number of carbon black particles, a mass of carbon black particles and an AdBlue® consumption.

According to another feature of the invention, the reference variable includes at least one variable selected from the group including an EGR rate, an EGR distribution, a filling, a charging pressure, an injection point in time, an ignition point in time and a rail pressure.

According to a further feature of the invention, at least two actual emission variables, in particular NOx emissions and carbon black emissions, are considered.

According to a specific embodiment of the invention, there is provided a control unit (1) for a combustion engine (2), with a function that, while taking into account operating state information (FW, SB), an upper limit and a cumulative actual variable, determines a reference variable (x(t)) including at least one of the variables EGR rate, EGR distribution, filling, charging pressure, injection point in time, ignition point in time or rail pressure, that influences an operating state of the combustion engine (2) so that a plurality of actual variables are adjusted such that cumulative actual variables do not exceed upper limits in an operating time period with a combination of arbitrary different operating states of the combustion engine (2) that are set up in random order in the operating time period, wherein a target function including at least one actual emission variable ($Em^{DS}$), a fuel consumption and/or $CO_2$ emissions is minimized by selecting the reference variable (x(t)) from Pareto-optimal alternatives through use of an indifference curve (I).

With the objects of the invention in view there is also provided a combustion engine including a control unit having a function that determines a reference variable by taking into account an operating state information, an upper limit and a cumulative actual variable, wherein the reference variable influences an operating state of the combustion engine such that a plurality of actual variables are adjusted so that, in an operating time period with a combination of arbitrary different operating states of the combustion engine that are set in a random order, cumulative actual variables do not exceed upper limits in the operating time period, wherein a target function is minimized by selecting the reference variable from Pareto-optimal alternatives through use of an indifference curve.

With the objects of the invention in view there is further provided a vehicle including a combustion engine having a control unit with a function that determines a reference variable by taking into account an operating state information, an upper limit and a cumulative actual variable, wherein the reference variable influences an operating state of the combustion engine such that a plurality of actual variables are adjusted so that, in an operating time period with a combination of arbitrary different operating states of the combustion engine that are set in a random order, cumulative actual variables do not exceed upper limits in the operating time period, wherein a target function is minimized by selecting the reference variable from Pareto-optimal alternatives through use of an indifference curve.

A control unit of a combustion engine in accordance with the invention determines a reference variable (for example EGR Rate, EGR distribution, filling) that is output to the combustion engine while taking into account operating state information, upper emission limits and a cumulative actual emission variable.

The operating state information includes for example the revolution rate, the current torque, the desired torque, the temperature, the DPF loading and other variables.

The cumulative actual emission variable includes the sum of all emissions emitted by the combustion engine in a certain operating time period.

Through the use of the reference variable(s), at least one operating state of the combustion engine is set so that a plurality of actual emission variables are influenced so that the cumulative actual emission variables, within a certain operating time period with a combination of different arbitrary operating states of the combustion engine that are set up in a random order, do not exceed upper emission limits (mg/km) for this operating time period and a target function is reduced as far as possible. Here a variable to be minimized or to be optimized is referred to as a target function (for example fuel consumption or the $CO_2$ emissions that are dependent thereon, regeneration intervals of various exhaust aftertreatment systems such as carbon black particle filters, AdBlue® (aqueous urea solution) consumption, NOx emissions etc. or a combination of such variables).

The term "arbitrary" operating states shall include all technically meaningful operating states that can occur during the intended normal operation of a combustion engine.

Such a control concept has the advantage that for example a non-critical actual emission variable is increased by a change of the reference variable such that a critical actual emission variable is reduced so that it is ensured that the emission limit level (emission limit value) of an emission variable for the critical emission variable is not reached or exceeded in a period of time.

In one embodiment, one or more reference variable(s) is/are selected through the use of an indifference curve from Pareto-optimal alternatives—of for example injection quantity, actual emissions and/or AdBlue® dosing. This takes place according to a heuristic method that takes into account the distances of the cumulative actual emissions from their limit level. The reference variable is thus determined or adapted dynamically and depending on the situation with this method.

There are implementations according to which the operating state information includes at least a revolution rate (n) and a setpoint torque (M).

According to one embodiment, the actual emission variables include at least two of the following variables. The variables include NOx emissions, HC emissions, CO emissions, $CO_2$ emissions, combined HC and NOx emissions, the number of carbon black particles, the mass of carbon black particles, the state of a diesel particle filter and the state of a NOx storage catalytic converter.

In another embodiment, the reference variable includes at least one of the following variables that affect the emission behavior, namely EGR rate, EGR distribution, filling and ignition point in time. The control variables that are derived therefrom include in this case one of the following variables, through the use of which the desired reference variable can be achieved with modern engines, namely the choke flap position; the variable turbine geometry setting, the injection point in time and the camshaft adjustment.

In another embodiment, two actual emission variables are considered, which are in particular the oxides of nitrogen emission and the carbon black emission, which are in a competing relationship in diesel engines.

With the help of a combustion engine with a control unit according to the invention, improved consumption values and emission values can be achieved. Such a combustion engine is particularly suitable for vehicles.

Although the invention is illustrated and described herein as embodied in a control unit for a combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DETAILED DESCRIPTION OF THE INVENTION

Figure 1:
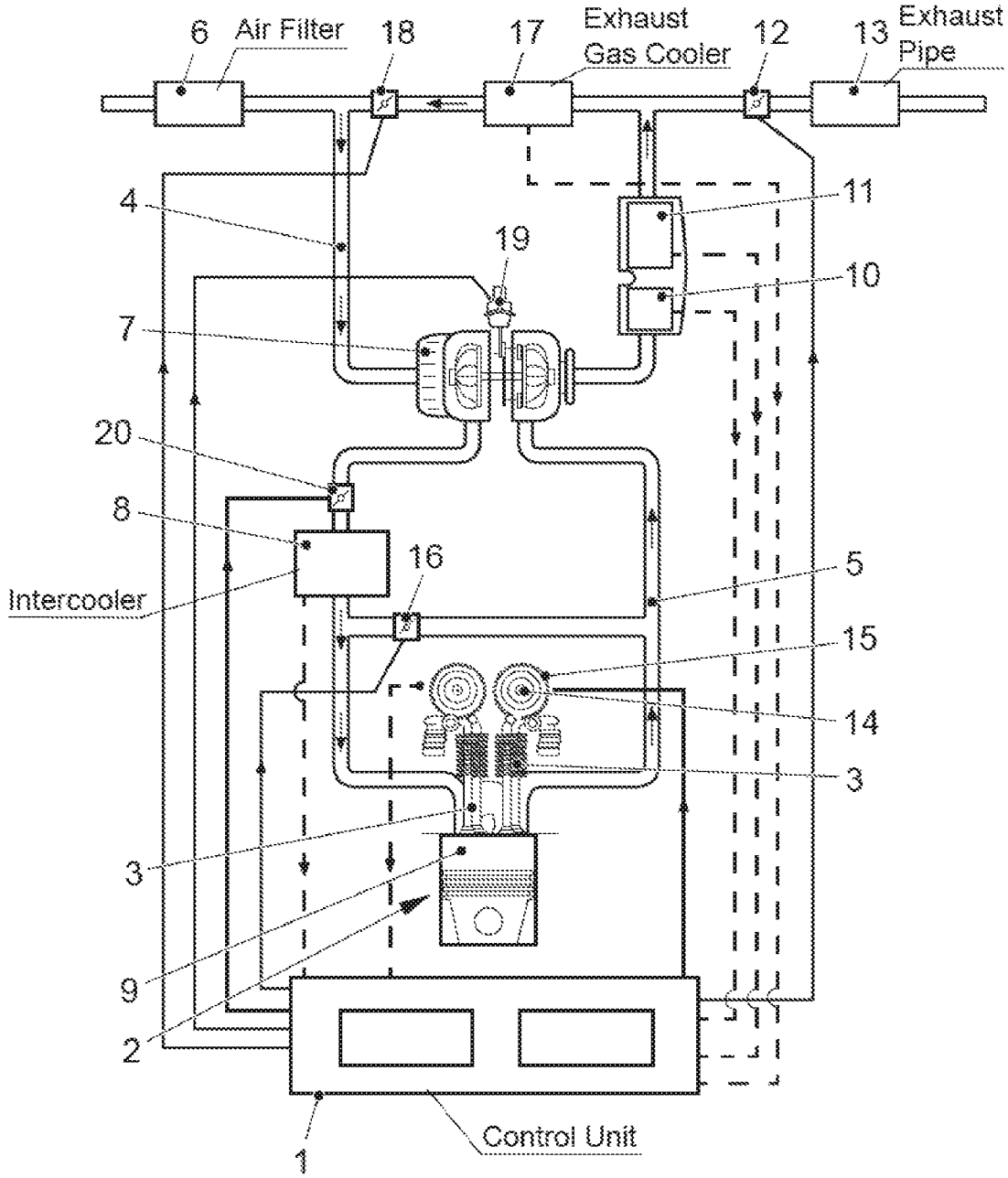
FIG. 1 is a diagrammatic view of an engine system with a control unit according to the invention.

Referring now to the figures of the drawing in detail and first, particularly, to FIG. 1 thereof, there is shown an engine schematic that is regulated or controlled through the use of a control unit 1 according to the invention. A combustion engine implemented as a reciprocating piston engine 2 (diesel or Otto-cycle engine) is represented, which is filled via valves 3 and via a charging air tract 4 and that is evacuated via an exhaust tract 5. The input air passes through an air filter 6 and an exhaust gas turbocharger 7 with variable turbine geometry, through an intercooler 8 via an inlet valve 3 into the cylinder, where fuel may be injected through the use of an injection system. Following the compression and combustion of the air-fuel mixture, the resulting exhaust gas is discharged through an exhaust valve 3 via the exhaust tract.

During this, the compressed exhaust gas passes through the exhaust gas turbocharger 7, drives the exhaust gas turbocharger and thus compresses the charging air. It then passes through an oxides of nitrogen storage catalytic converter 10 and a diesel particle filter 11 and finally passes through an exhaust flap 12 into the exhaust pipe 13.

The valves 3 are driven via a variable camshaft 14. The adjustment is carried out via a camshaft adjuster 15 that can be actuated by the control unit 1.

Some of the exhaust gas can be fed into the charging air tract 4 via a high-pressure exhaust gas recirculation valve 16. An exhaust gas treated partial flow can be fed via a suitable exhaust gas cooler 17 and an exhaust gas recirculation low pressure valve 18 into the charging air tract 4 in the low-pressure region after the exhaust gas turbocharger 7. The turbine geometry of the exhaust gas turbocharger 7 is adjustable through the use of an actuator 19. The charging air feed ("Gas") is regulated through the use of the main throttle flap 20.

Inter alia, the exhaust gas recirculation low pressure valve 18, the actuator 19, the main throttle flap 20, the exhaust gas recirculation high pressure valve 16, the camshaft adjuster 15 and the exhaust flap 12 can be actuated (solid lines) via the control unit 1.

Furthermore, the control unit 1 is supplied with temperature information (intercooler 8, exhaust gas cooler 17) through the use of sensors and setpoint generators for example, and with actual emission values (for example from a sensor or physical/empirical model).

Yet more operating state information can be used for this purpose: accelerator pedal position, choke flap position, air mass, battery voltage, engine temperature, crankshaft revolution rate and top dead center, selected gear and the speed of the vehicle.

There is thus a complex control and regulating system that will adjust, regulate and optimize as far as possible the engine operation in respect of different target variables (command variables) in diverse operating states.

The following exemplary embodiments relate to the control and regulation of emission values depending on predetermined upper emission limits and cumulative actual values.

Figure 2:
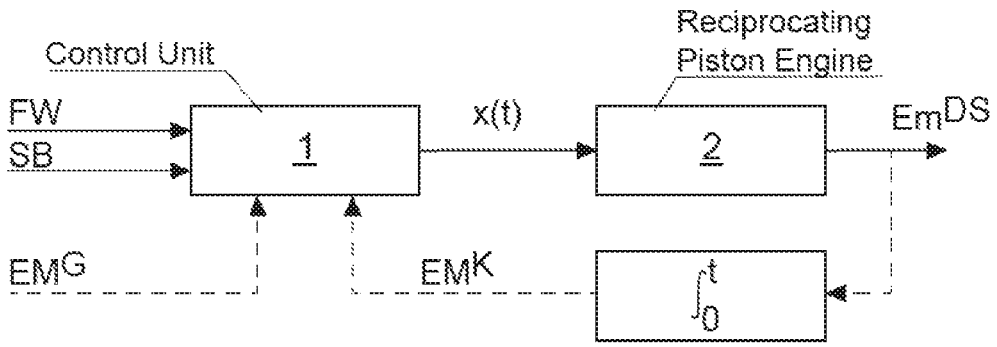
FIG. 2 shows a schematic representation of input and output variables, as well as the information processing of a control unit according to the invention.

Such a basic system is represented in FIG. 2. In this case, the control unit 1 determines one or more reference variables x(t) that are necessary and effective for influencing the emissions.

From the reference variables, control variables are derived, which, in the combustion engine 2 or the components thereof (for example position of the main throttle flap 20, camshaft setting, the setting of the turbine geometry of the exhaust gas turbocharger 7, the setting of the exhaust flap 12, etc.), influence the emissions (for example NOx, HC, CO, carbon black) of the combustion engine. The emissions are detected as mass flows (emission rates) $Em^{DS}$ (for example mass per unit time [mg/s]). From these emissions, cumulative actual values $Em^{K}$ of the emissions are derived (integration of the emission rates over time).

The reference variable(s) x(t) are determined in the control unit 1 from the cumulative actual values $Em^{K}$, together with the elapsed operating time t or the distance covered s, known or predetermined upper emission limits $Em^{G}$ and information about the driver's intentions FW (for example acceleration: $a^{Soll}$; torque: $M^{Soll}$) and other operating conditions SB (for example speed: v; revolution rate: n) of the combustion engine 2.

Figure 3:
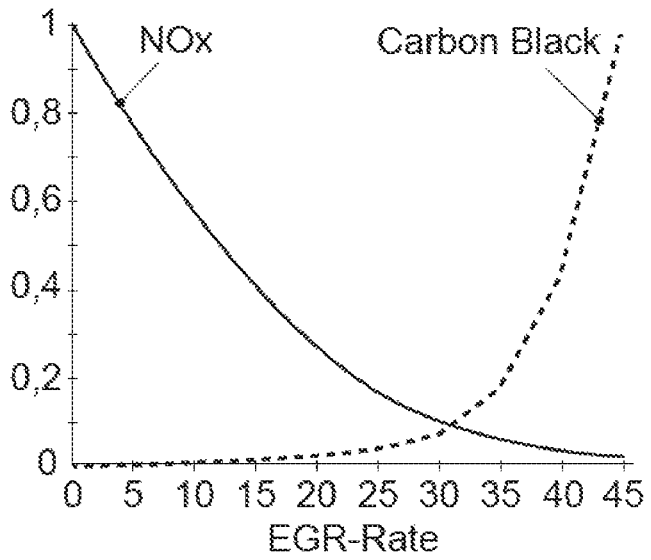
FIG. 3 is a diagram illustrating carbon black and NOx emissions represented as a function of the EGR rate in accordance with the invention.

FIG. 3 shows by way of example the relationship between NOx emissions and carbon black emissions as a function of the exhaust gas recirculation rate (EGR), which forms a reference variable x(t) here. The diagram shows that by increasing the EGR the NOx emissions can indeed be reduced, but in doing so the carbon black emissions rise.

Figure 4:
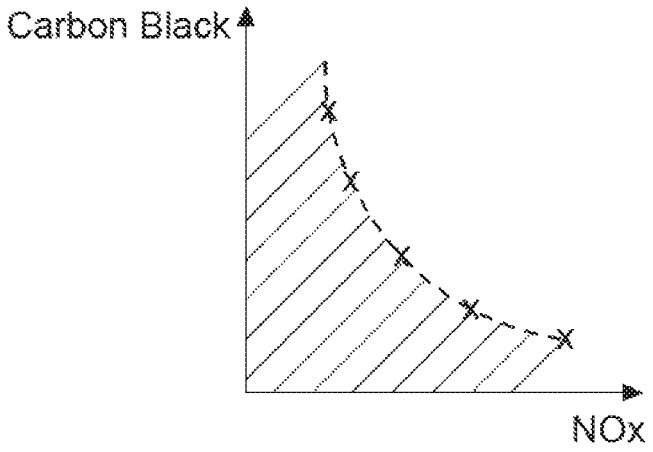
FIG. 4 is a diagram illustrating Pareto-optimal working points for which a certain carbon black emission and a certain NOx emission apply in accordance with the invention.

FIG. 4 shows a diagram with combinations of reference variables of determined carbon black emissions that are plotted against determined NOx emissions. If the object is now for example to minimize/to reduce the carbon black emissions in an (arbitrary) operating state, but in doing so to conform to a (cumulative) NOx limit value, the emissions history (cumulative actual values $Em^G$) for past operating states (possibly arbitrary different operating states set in random order) must be taken into account.

Pareto-optimal target variable combinations, for which the carbon black emission can only be lowered further if the NOx emission is increased, are identified by the x points. All Pareto-optimal target variable combinations form the so-called Pareto front, which connects the x points to each other. In the case of a minimization problem, points to the left below the Pareto front (hatched region) cannot be achieved and all target variable combinations provided on the right and above are not Pareto-optimal, because in each case there are combinations (x points) that can be more favorably achieved on the Pareto front, both with respect to carbon black emissions and NOx emissions.

Figure 5:
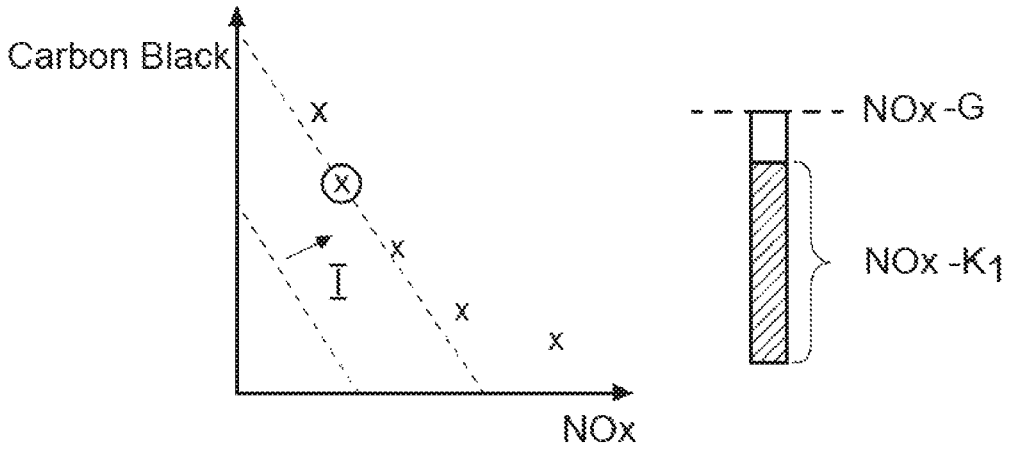
FIG. 5 is a diagram illustrating the selection of a reference variable by an indifference curve based on the relationship of carbon black emissions and NOx emissions for a certain (increased) cumulative NOx emission in accordance with the invention.

The representation in FIG. 5 shows the selection of two target variables (NOx emissions and carbon black emissions) from Pareto-optimal target variable combinations. In the column on the right, a NOx limit value NOx-G (dashed line) is indicated as the upper emission limit Ems and the column represented below this shows the NOx emissions NOx-$K_1$ accumulated so far in the hatched region as the cumulative actual value $Em^K$. Because the cumulative NOx emissions NOx-$K_1$ are already relatively close to the NOx limit value NOx-G, a relatively high exchange ratio between the target variables carbon black emissions and NOx emissions is selected here (increased carbon black emissions, benefiting low NOx), in order not to exceed the NOx limit value NOx-G. The desired exchange ratio is indicated by the indifference curve I here, which is shown decreasing relatively steeply here, and is then shifted to the nearest target variable combination, in which a certain carbon black emission and a certain NOx emission can be achieved for this operating point. The target variable combination is then assigned an EGR as a suitable Pareto-optimized reference variable x(t) using the information known from the diagram of FIG. 3.

Figure 6:
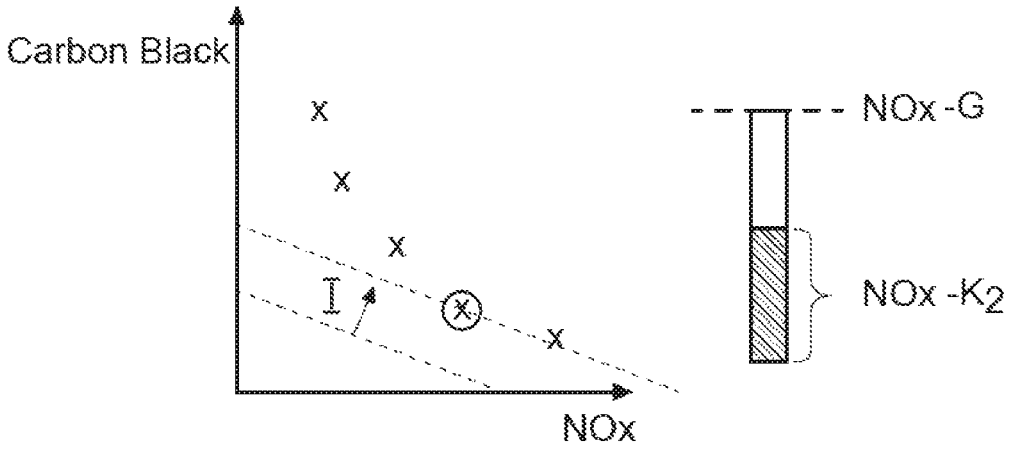
FIG. 6 is a diagram illustrating the selection represented in FIG. 5 for a lower cumulative NOx emission in accordance with the invention.

FIG. 6 shows an example in which cumulative NOx emissions (NOx-$K_2$) lie further below the NOx limit value NOx-G. Here the exchange ratio of the indifference curve I is smaller (the straight line decreases less steeply). Here a higher NOx emission can thus be accepted without a risk of the NOx limit value NOx-G being exceeded. Thus, the carbon black emission can be kept lower. The more gently sloping straight line is shifted to the next target variable combination, at which a certain NOx emission and a corresponding carbon black emission can be achieved with an associated reference variable x(t) (here the corresponding EGR of FIG. 3).

Figure 7:
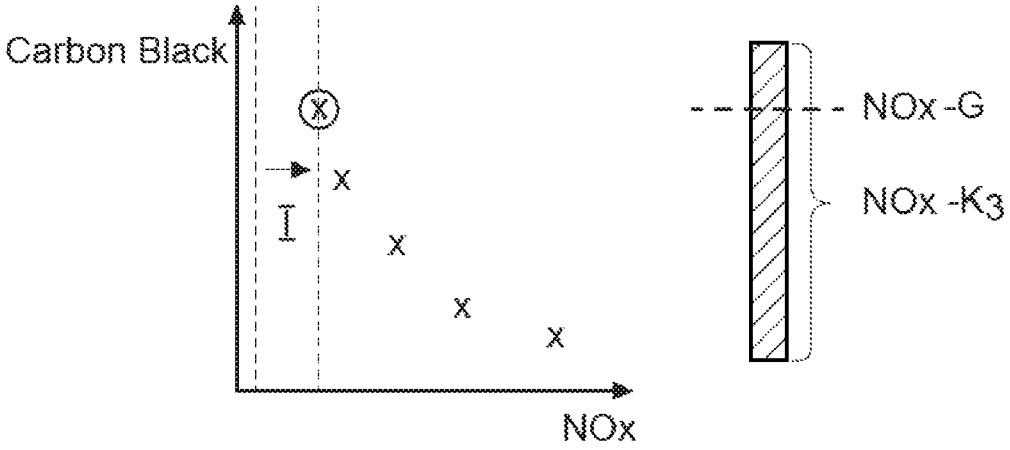
FIG. 7 is a diagram illustrating the selection represented in FIG. 5 for an excessive cumulative NOx emission in accordance with the invention.

FIG. 7 shows an example in which the cumulative NOx emissions (NOx-$K_3$) have exceeded the NOx limit value NOx-G. Here the exchange ratio of the straight lines I (vertical indifference curve) is quasi infinite. Regardless of the level of the carbon black emissions, the reference variable x(t) is selected for minimal NOx emissions.

Figure 8:
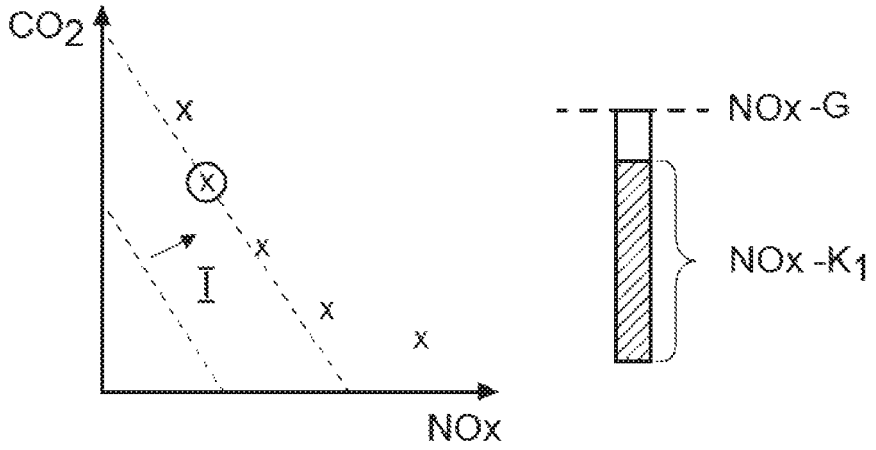
FIG. 8 is a diagram illustrating the selection represented in FIG. 5 based on the relationship of $CO_2$ and NOx emissions in accordance with the invention.

FIG. 8 shows, similarly to FIG. 5, an example in which $CO_2$ will be minimized depending on the cumulative NOx emissions.

Figure 9:
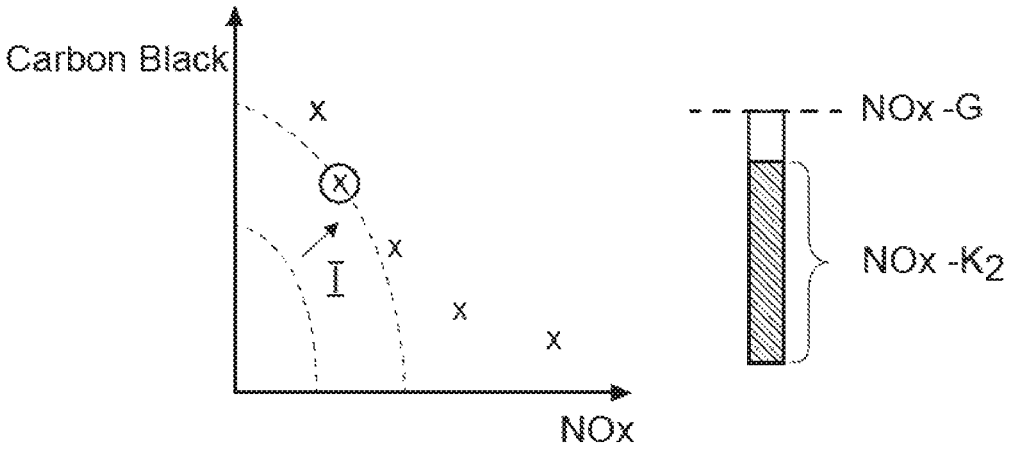
FIG. 9 is a diagram illustrating the selection represented in FIG. 5 by a non-linear indifference curve in accordance with the invention.

FIG. 9 shows, similarly to FIG. 5, an example in which the indifference curve is not linear.

With the approach illustrated, the emission values (target functions) can be improved during operation and depending on changing boundary conditions. In addition to the problems illustrated here, for which emission variables have been considered in pairs, the method can also be extended to multi-dimensional problems. Thus for example, it is possible to determine Pareto-optimized reference variables x(t) for multiple combinations (for example for $CO_2$ emissions, carbon black emissions and NOx emissions). In addition to the reference variable EGR, other reference variables x(t) can be determined as Pareto-optimized for regulation (for example VTG position or rail pressure).

LIST OF REFERENCE CHARACTERS

1 control unit
2 reciprocating piston engine
2*a* gearbox
3 valves
4 charging air tract
5 exhaust tract
6 air filter
7 exhaust gas turbocharger
8 intercooler
9 cylinder
10 NOx storage catalytic converter
11 diesel particle filter
12 exhaust flap
13 exhaust pipe
14 camshaft
15 camshaft adjuster
16 EGR high pressure valve
17 exhaust gas cooler
18 EGR low pressure valve
19 actuator
20 main throttle flap
x(t) reference variable
NOx-G limit value
NOx-$K_1$ cumulative actual value
FW driver's intentions
SB other operating conditions
$EM^G$ upper emission limit
$EM^K$ cumulative emission values
$EM^{DS}$ emission throughputs
I indifference curve

What is claimed is:

1. A control configuration for a combustion engine, comprising:

a control unit programmed to:

determine a reference variable defined by at least one of an EGR rate, an EGR distribution, a cylinder filling parameter, a charging pressure, a fuel rail pressure, an injection point in time, and an ignition point in time by taking into account engine operating state information and upper limits of cumulative actual emission variables, wherein said cumulative actual emission variables comprise a plurality of respective actual emission variables that are accumulated over an operating time period during real driving operations of the combustion engine;

select said reference variable from Pareto-optimal alternatives through use of an indifference curve by taking into account distances of said cumulative actual emission variables from said upper limits to thereby minimize a target function; and control an operating state of the combustion engine in accordance with the selected reference variable, such that said plurality of respective actual emission variables are adjusted in real-time so that, in said operating time period with a combination of arbitrary different operating states of the combustion engine that are set in a random order, said cumulative actual emission variables do not exceed said upper limits in said operating time period.

2. The control configuration according to claim 1, wherein said target function includes at least one variable selected from the group consisting of an actual emission variable, a fuel consumption and a $CO_2$ emission.

3. The control configuration according to claim 1, wherein said engine operating state information includes a revolution rate and a setpoint torque.

4. The control configuration according to claim 1, wherein said operating time period and different operating states of a trip are known.

5. The control configuration according to claim 1, wherein said actual emission variables include at least two variables selected from the group consisting of a NOx emission, a HC emission, a CO emission, a $CO_2$ emission, a combined HO and NOx emission, a carbon black emission, and an AdBlue® consumption.

6. The control configuration according to claim 1, wherein at least two actual emission variables are considered.

7. The control configuration according to claim 6, wherein said at least two actual emission variables include a NOx emission and a carbon black emission.

8. A combustion engine comprising:

a control unit programmed to:

determine a reference variable defined by at least one of an EGR rate, an EGR distribution, a cylinder filling parameter, a charging pressure, a fuel rail pressure, an injection point in time, and an ignition point in time by taking into account engine operating state information and upper limits of cumulative actual emission variables, wherein said cumulative actual emission variables comprise a plurality of respective actual emission variables that are accumulated over an operating time period during real driving operations of the combustion engine;

select said reference variable from Pareto-optimal alternatives through use of an indifference curve by taking into account distances of said cumulative actual emission variables from said upper limits to thereby minimize a target function; and control an operating state of the combustion engine in accordance with the selected reference variable, such that said plurality of respective actual emission variables are adjusted in real-time so that, in said operating time period with a combination of arbitrary different operating states of the combustion engine that are set in a random order, said cumulative actual emission variables do not exceed said upper limits in said operating time period.

9. A vehicle including a combustion engine, comprising:

a control unit programmed to:

determine a reference variable defined by at least one of an EGR rate, an EGR distribution, a cylinder filling parameter, a charging pressure, a fuel rail pressure, an injection point in time, and an ignition point in time by taking into account engine operating state information and upper limits of cumulative actual emission variables, wherein said cumulative actual emission variables comprise a plurality of respective actual emission variables that are accumulated over an operating time period during real driving operations of the combustion engine;

select said reference variable from Pareto-optimal alternatives through use of an indifference curve by taking into account distances of said cumulative actual emission variables from said upper limits to thereby minimize a target function; and control an operating state of the combustion engine in accordance with the selected reference variable, such that said plurality of respective actual emission variables are adjusted in real-time so that, in said operating time period with a combination of arbitrary different operating states of the combustion engine that are set in a random order, said cumulative actual emission variables do not exceed said upper limits in said operating time period.

* * * * *